US010001283B2

(12) United States Patent
Kramer et al.

(10) Patent No.: US 10,001,283 B2
(45) Date of Patent: Jun. 19, 2018

(54) COOKING DEVICE WITH FAT DRAIN

(75) Inventors: Gerhard Kramer, Untermuehlhausen (DE); Hubert Brunner, Weil (DE)

(73) Assignee: RATIONAL AKTIENGESELLSCHAFT, Landsberg am Lech (DE)

( * ) Notice: Subject to any disclaimer, the term of this patent is extended or adjusted under 35 U.S.C. 154(b) by 130 days.

(21) Appl. No.: 13/560,013

(22) Filed: Jul. 27, 2012

(65) Prior Publication Data

US 2013/0032041 A1 Feb. 7, 2013

(30) Foreign Application Priority Data

Aug. 2, 2011 (DE) ..... 10 2011 109 282

(51) Int. Cl.
*A47J 27/00* (2006.01)
*F24C 15/14* (2006.01)

(52) U.S. Cl.
CPC ..... *F24C 15/14* (2013.01)

(58) Field of Classification Search
CPC ..... F24C 15/14; A21B 3/00
USPC ..... 99/340, 407, 446, 444, 339, 357, 419, 99/413, 448, 410
See application file for complete search history.

(56) References Cited

U.S. PATENT DOCUMENTS 4,945,893 A * 8/1990 Manchester ..... 126/391.1
5,713,265 A * 2/1998 Strader et al. ..... 99/446
6,362,458 B1 3/2002 Sargunam et al.
7,237,476 B1 * 7/2007 Bourgeois et al. ..... 99/340
7,377,210 B1 * 5/2008 Franco ..... 99/446
2005/0235980 A1 10/2005 Hansen et al.
2007/0256571 A1 * 11/2007 Popeil et al. ..... 99/407
2008/0264271 A1 * 10/2008 Hansen et al. ..... 99/446

FOREIGN PATENT DOCUMENTS

DE 29623987 U1 9/1996
DE 19636123 C1 1/1998
DE 29623987 U1 12/2000
DE 202006011755 U1 11/2006
DE 102006011755 A1 9/2007
WO 2004094912 A1 11/2004
WO 20040949122010128 A2 11/2010

OTHER PUBLICATIONS

German Search Report dated Apr. 23, 2012.
DE19636123(C1) English Abstract.
German Search Report dated Aug. 5, 2013.
DE202006011755(U1) English Abstract.
Machine translation of DE202006011755U1 from espacenet.com.

* cited by examiner

*Primary Examiner* — Phuong Nguyen
(74) *Attorney, Agent, or Firm* — Hayes Soloway PC

(57) ABSTRACT

In a cooking device having a cooking chamber including a plurality of side walls, a bottom, and a fat drain to allow fat and other cooking residues to be discharged therethrough from the cooking chamber outward, the fat drain is arranged in a side wall of the cooking chamber.

3 Claims, 4 Drawing Sheets

COOKING DEVICE WITH FAT DRAIN

CROSS REFERENCE TO RELATED APPLICATIONS

This application claims priority under 35 U.S.C. § 119 to German Patent Application No. DE 10 2011 109 282.3 filed Aug. 2, 2011, the contents of which are incorporated herein by reference thereto.

TECHNICAL FIELD

Exemplary embodiments of the present invention relates to a cooking device having a fat drain.

BACKGROUND

A cooking device having a fat drain is disclosed in DE 296 23 987. The fat drain is arranged in the bottom of the cooking chamber so that fat and other residues can be drained vertically downward through a pipe and into a collecting container. The pipe is provided with a valve so that the pipe and, hence, the fat drain can be closed off when the collecting container is to be exchanged. In addition, it is advisable to close the valve when an automatic cleaning program is executed in the cooking device, which is intended to clean the cooking chamber and various other functional components of the cooking device from dirt. If an operator fails to close the valve, part of the liquid used for cleaning runs through the fat drain and into the collecting container. In this case, not only the fat in the collecting container needs to be disposed of, but also the water accumulating therein. Since, however, the costs of fat disposal are comparatively high, it is basically undesirable to still add water to the fat to be disposed of.

WO 2010/128457 A2 discloses a cooking device with a fat drain having an electrically controlled valve associated therewith. This document describes that the valve can be opened in dependence on the respective cooking program used and that it preferably remains closed to the greatest possible extent. Use of such a valve can prevent that part of the cleaning liquid is drained off unintentionally through the fat drain during a cleaning program.

The object of the present invention is to further develop a cooking device of the type initially mentioned to the effect that it is prevented with a reduced effort that any larger quantities of the cleaning liquid exit through the fat drain in an undesirable manner during a cleaning program.

SUMMARY

To achieve this object, according to the invention provision is made for a cooking device having a cooking chamber which includes a plurality of side walls, a bottom, and a fat drain. Fat and other cooking residues can be discharged from the cooking chamber outward through the fat drain. The fat drain is arranged in a side wall of the cooking chamber. The invention is based on the finding that fat and other cooking residues need not necessarily be discharged through the bottom of the cooking chamber, as is shown throughout the prior art, but can also be discharged from the cooking chamber through a side wall thereof. If the fat drain is arranged on a side wall of the cooking chamber, only a very small part of the cleaning liquid will get into the fat drain during a cleaning program even when the fat drain is left completely unobstructed. It is therefore not necessary to provide any expensive, electrically operated valves that require to be driven by a controller.

According to one embodiment of the invention, provision is made that the fat drain is arranged in a rear wall of the cooking chamber. This allows the pipes that are used for discharging the fat and the cooking residues to be led on the rear side of the cooking device, so that it is still possible to install several cooking devices directly adjacent to each other.

Preferably, the fat drain is arranged at a small distance above the bottom. This allows a fat collecting pan to be arranged at as low a position as possible in the cooking chamber, the fat collecting pan being used for collecting and conducting the fat given off by the product to be cooked and other cooking residues to the fat drain. In this way, the waste of useful space for the food to be cooked is minimized as far as possible. The term "small distance" should be more particularly understood here to mean at least 5 mm, but at most 10 cm.

When the distance from the bottom is even smaller, it is to be expected that an appreciable portion of the cleaning liquid that accumulates at the bottom of the cooking device will enter the fat drain.

In a technically simple design, the fat drain may be designed in the form of a pipe extending through the side wall of the cooking chamber and through an outer wall of the cooking device outward to run to a collecting container there. A pipe of this type may be assembled with little effort from a variety of standardized sections (straight pipe sections and pipe elbows, for example) and adapted to the particular spatial conditions.

According to one configuration, provision is made that outside the cooking device, the pipe extends substantially vertically downward. This arrangement of the pipe is of advantage in particular when the collecting container for the fat and the cooking residues is to be arranged below the cooking device. In addition, in the case of a vertically extending pipe, the risk of fat being deposited in the pipe and resulting in major dirt accumulation in the long term is fairly low.

According to an alternative configuration, provision is made that the pipe first runs toward the side with a slight slope and then vertically downward. This allows a collecting container to be arranged laterally of the cooking device.

Preferably, provision is made that a closure member is arranged on the end of the pipe. This allows a collecting container to be exchanged even during operation, by closing the valve for a short period of time while an empty collecting container is substituted for a full container.

According to one configuration of the invention, provision is made for a pipe heating. A pipe heating can be used to prevent fat that rapidly cools down outside of the cooking device from settling in the pipe and thus resulting in major dirt accumulation in the long term.

According to one configuration, provision is made that the pipe heating is formed by resistance heating members arranged along the pipe. In this way, the wall of the pipe can be heated up with little effort to such an extent that any fat deposits are liquefied and drained from the pipe. The pipe heating can be switched on automatically in predetermined intervals by a controller of the cooking device so as to counteract dirt accumulation.

According to one embodiment of the invention, the fat drain is provided with a closure member. This allows the fat drain to be closed off completely when, for example, a cleaning program is to be executed or else when cooking programs run which require the cooking chamber to be tightly sealed.

According to a mechanically simple configuration, provision is made that the closure member is in the form of a manually insertable plug, which can be manually inserted into the fat drain by an operator.

Provision is made according to an alternative configuration that the closure member is in the form of an automatic flap adapted to cooperate with a fat collecting pan. In this design the fat collecting pan automatically opens the fat drain when it is arranged in the cooking chamber, so that the fat and other cooking residues can drain out of the cooking chamber. As soon as the fat collecting pan is removed again, the closure member will automatically close off the fat drain.

BRIEF DESCRIPTION OF THE DRAWINGS

The invention will now be described below with reference to various embodiments which are illustrated in the accompanying drawings, in which.

DETAILED DESCRIPTION OF THE INVENTION

Figure 1:
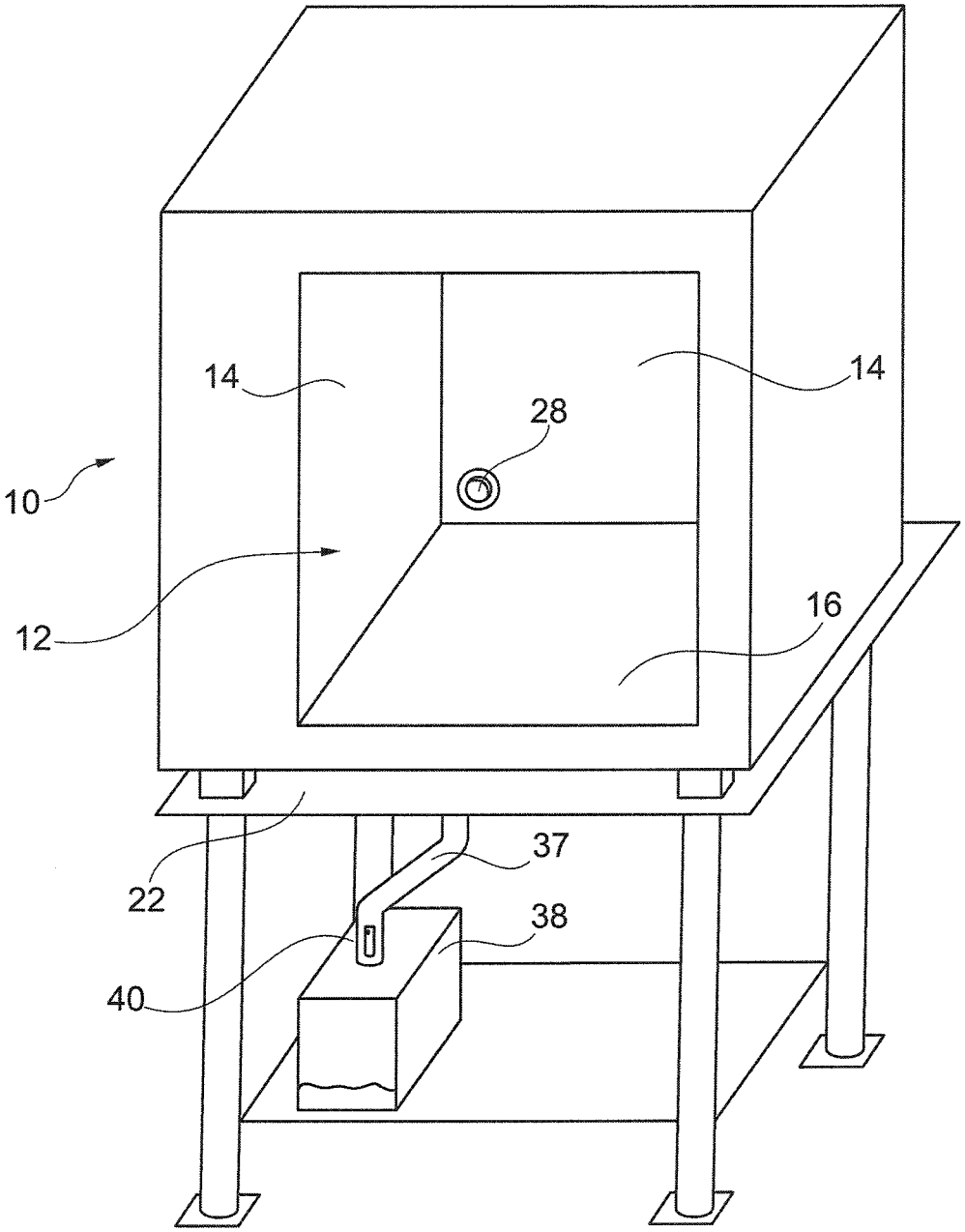
FIG. 1 shows a schematic, perspective front view of a cooking device according to a first embodiment of the invention.
Figure 2:
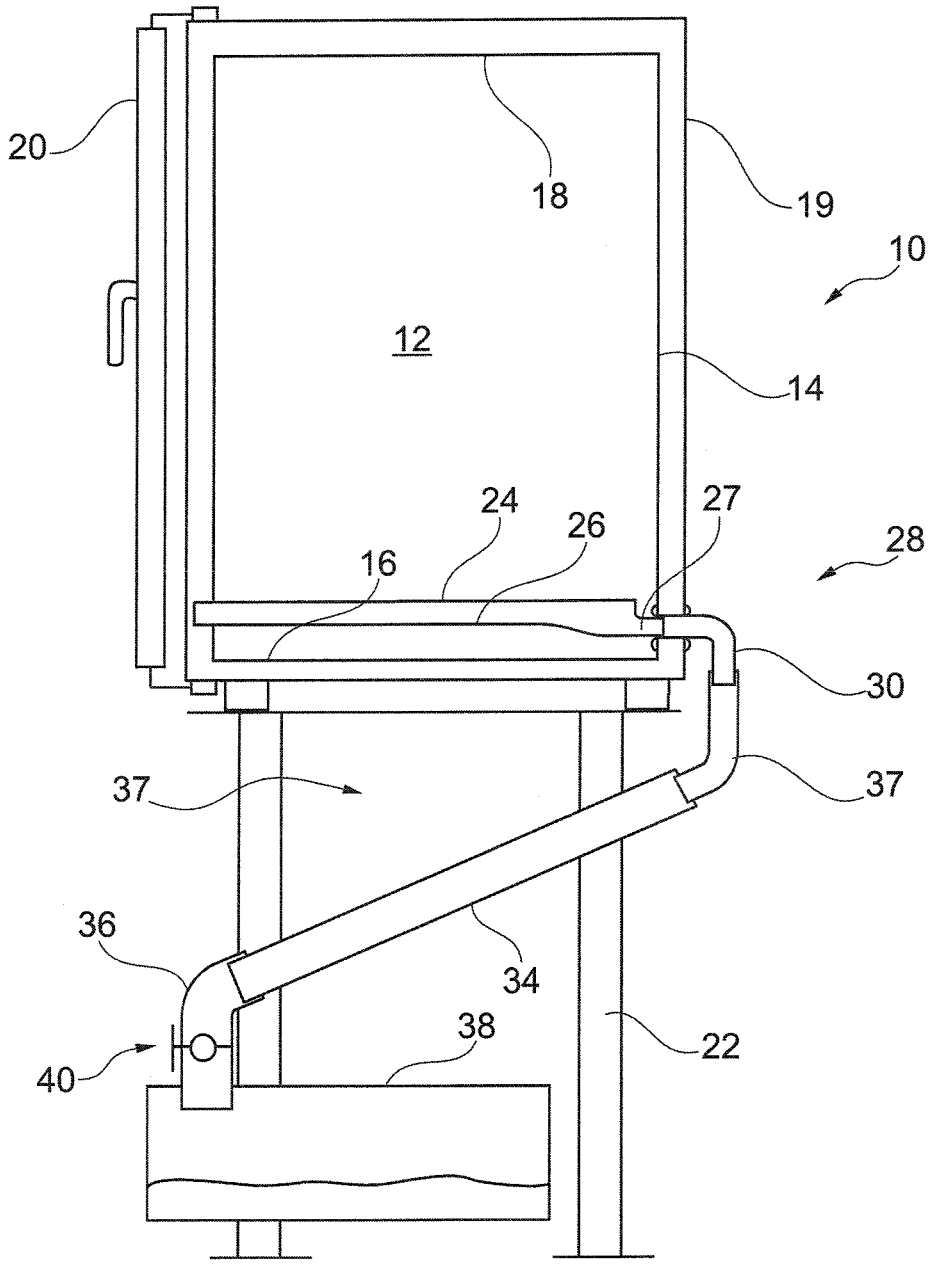
FIG. 2 shows a schematic, sectional side view of the cooking device of FIG. 1.

FIGS. 1 and 2 show a cooking device 10 that is intended for professional use, for example in company canteens or restaurants. It contains a cooking chamber 12 into which food to be cooked can be placed, which is then cooked to a desired condition in a cooking chamber atmosphere predefined by the cooking device. The cooking chamber 12 includes three side walls 14, a bottom 16, and a ceiling 18. One side of the cooking chamber can be closed by a door 20 (not shown in FIG. 1). To place the food to be cooked into the cooking chamber, the latter is typically provided with a hang-in rack (not shown), for baking sheets or other supports for food to be cooked to be inserted therein, for instance.

In the embodiment shown, the cooking device 10 is arranged on a support frame 22. But depending on the particular design of the cooking device and its size, the cooking device may also be arranged in a different fashion.

When it is intended to cook food in the cooking chamber 12 from which a large amount of fat drips during the cooking process, a fat collecting pan 24 (see FIG. 2) is inserted into the cooking chamber 12, for example into the lowermost slot of the hang-in rack. The fat collecting pan 24 has a pan bottom 26 sloping obliquely toward one point, so that the fat dripping into the fat collecting pan 24 and other cooking residues flow to the lowest point of the fat collecting pan, where a spout extension 27 is arranged, for the fat and the other cooking residues to flow therethrough and out of the fat collecting pan 24.

In order to discharge the collected fat and the other cooking residues out of the cooking chamber 12, the latter is provided with a fat drain 28 into which the spout extension 27 of the fat collecting pan 24 extends. In simplified terms, the fat drain 28 is embodied as a passage through one of the side walls 14 of the cooking device from the cooking chamber 12 outward. In the embodiment shown in FIGS. 1 and 2, the fat drain 28 is arranged on the rear side wall 14, i.e. the rear wall, of the cooking chamber, and is located here at a distance of a few centimeters above the bottom 16. As can be seen in particular in FIG. 2, the fat drain 28 is formed by a pipe elbow 30 here, one leg of which extends through the rear side wall 14 of the cooking chamber and through the corresponding outer wall 19 of the cooking device. The pipe elbow 30 is adjoined by a further pipe elbow 32, which for its part continues into a straight pipe section 34. The straight pipe section 34 is adjoined by a terminal elbow 36 which is located approximately below the door 20 of the cooking device and leads into a collecting container 38. Arranged within the terminal elbow 36 is a shut-off member 40 which can be operated manually to allow the drainage from the cooking chamber 12 to be shut off shortly before the collecting container 38, for instance to allow the collecting container to be exchanged. The connection from the fat drain 28 to the collecting container will also be referred to as pipe 37 in short below.

The fat collecting pan 24 is formed such that the lowest point of its pan bottom 26 is located at the rear edge of the fat collecting pan, more specifically on that side on which the fat drain 28 is also arranged. As can be seen in FIG. 2, a spout projection of the fat collecting pan extends directly into the fat drain 28, so that fat and other cooking residues collected in the fat collecting pan 24 flow on the pan bottom 26 and into the fat drain 28 and flow from there further to the collecting container 38.

In the embodiment of FIGS. 1 and 2, the collecting container 38 is arranged below the cooking device 10 on the same side as the fat drain 28. Alternatively to the course as shown of the pipe connecting the fat drain 28 with the collecting container 38, a substantially vertically extending pipe could also be used. In that case it would be a disadvantage that the shut-off member 40 would be poorly accessible.

Figure 3:
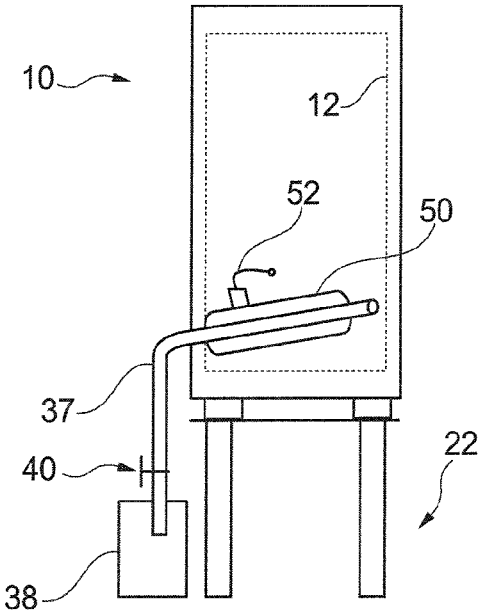
FIG. 3 shows a schematic rear view of a cooking device according to a second embodiment of the invention.
Figure 4:
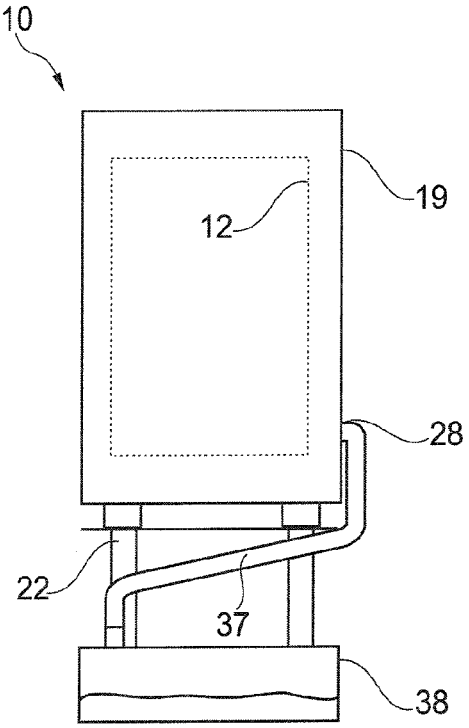
FIG. 4 shows a schematic side view of the cooking device of FIG. 3.

In the embodiment shown in FIGS. 3 and 4, the collecting container 38 is arranged laterally of the cooking device 10. For this reason, starting from the fat drain 28, the pipe 37 first extends obliquely laterally along the rear wall of the cooking device (see FIG. 3) and then downward and forward on the side of the cooking device (see FIG. 4) toward the inlet of the collecting container 38. Here, too, a shut-off member 40 is provided.

Provided on the pipe 37 here is a pipe heating 50 including resistance heating members. The pipe heating 50 is electrically connected by a cable 52 to the power supply and to a controller of the cooking device 10, the controller being adapted to switch the pipe heating 50 on when required. Such a pipe heating is useful in particular for pipe sections that extend with a comparatively low slope where, due to the lower flow rate of the fat discharged, there is an increased risk that the fat cools down, settles, and finally plugs up the pipe 37. By means of the pipe heating, any fat that may have settled can be heated to such an extent that it will flow again and drain toward the collecting container 38. In the process, the controller can either switch on the pipe heating 50 manually if an operator considers this to be expedient, or switch it on in an automated fashion, for instance after a particular operating period or a particular number of cooking processes for food requiring a large amount of fat to be discharged (such as roast chicken, for instance).

Figure 5:
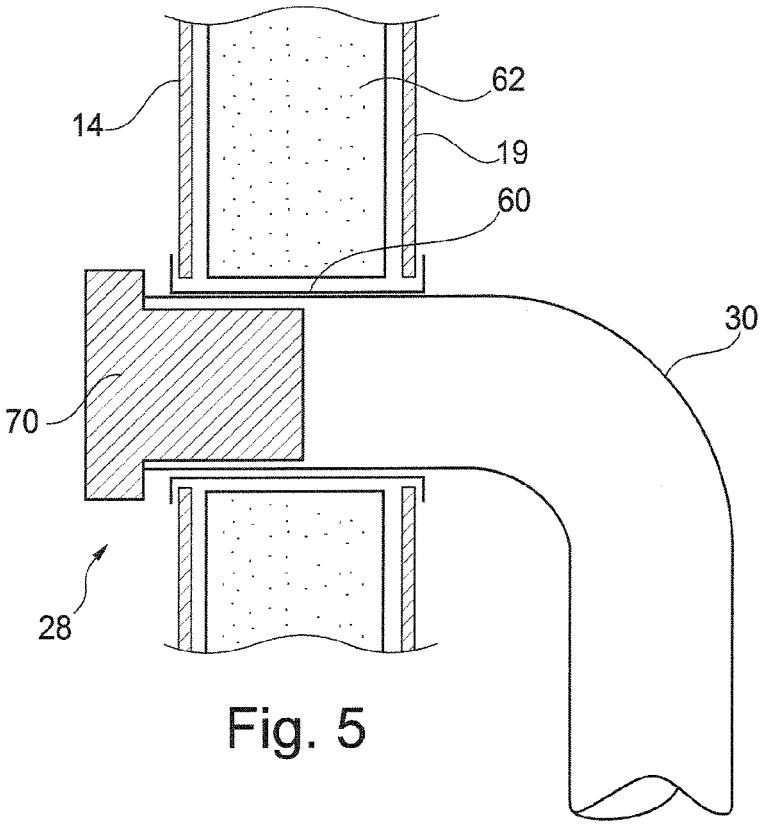
FIG. 5 shows a detail of a fat drain according to a first variant.

FIG. 5 shows, on an enlarged scale, a fat drain 28 which is in the form of a connecting piece 60 here which extends from an opening in the rear wall 14 of the cooking device through an insulation 62 and toward an opening in the rear outer wall 19. The pipe elbow 30 is tightly fitted in the connecting piece 60.

Associated with the fat drain 28 here is a closure member in the form of a plug 70 that can be inserted into the fat drain 28 in the cooking chamber 12 to close off the fat drain 28. This is advisable, for instance, before a cleaning program is started. The plug 70 will then prevent cleaning liquid from draining through the fat drain 28 and the pipe 37 to the collecting container 38. The plug 70 may be suitably attached inside the cooking chamber, for instance on a short chain, to prevent it from being lost.

For sealing the passage of the fat drain 28 through the wall of the cooking device, a seal may be used, which is not illustrated in the drawings. The sealing point is preferably located outside the cooking device. As a result, the seal is not exposed to any high thermal loads. This seal may be mounted in that a large passage opening is provided in the outer rear wall of the cooking device.

Figure 6:
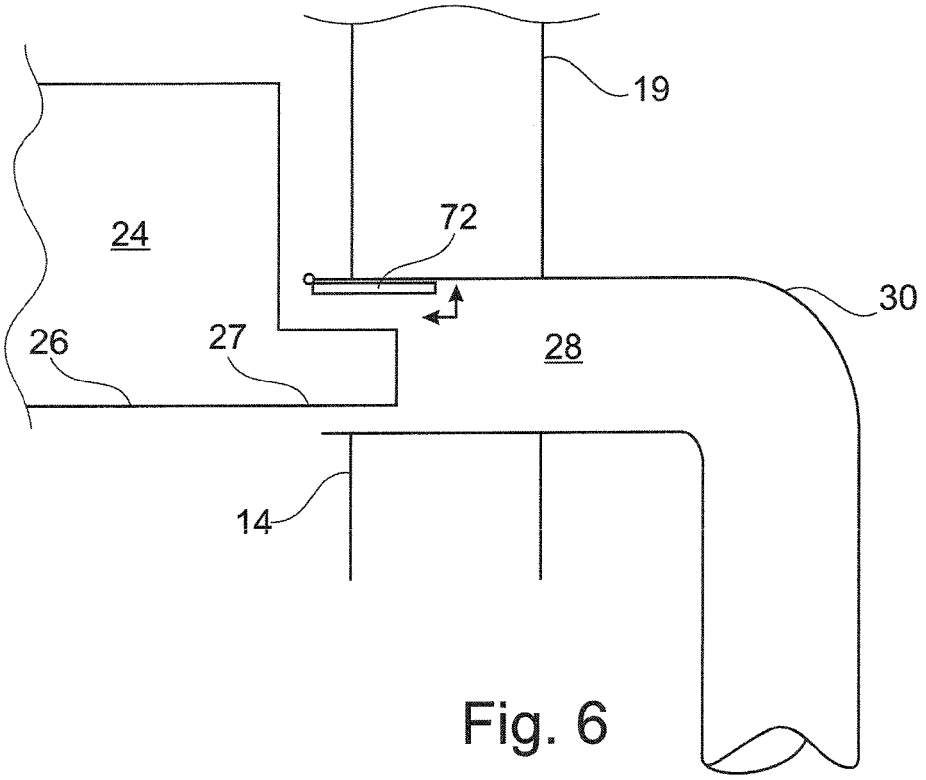
FIG. 6 schematically shows a detail of a fat drain according to a second variant.

In FIG. 6, an alternative configuration of a closure member for the fat drain 28 is provided. A flap 72 is used here, which is opened by the spout extension 27 of the fat collecting pan 24 when the latter is fitted into the cooking chamber 12. When the fat collecting pan 24 is removed again, the flap 72 will automatically close off the fat drain 28. This may be ensured by the flap's own weight or as assisted by a spring.

To facilitate connecting the spout extension 27 of the fat collecting pan 24 with the fat drain, the extension 27 is designed to be beak-shaped while the fat drain 28 can be provided with a funnel-shaped widening (not shown) on the side of the cooking chamber.

Figure 7:
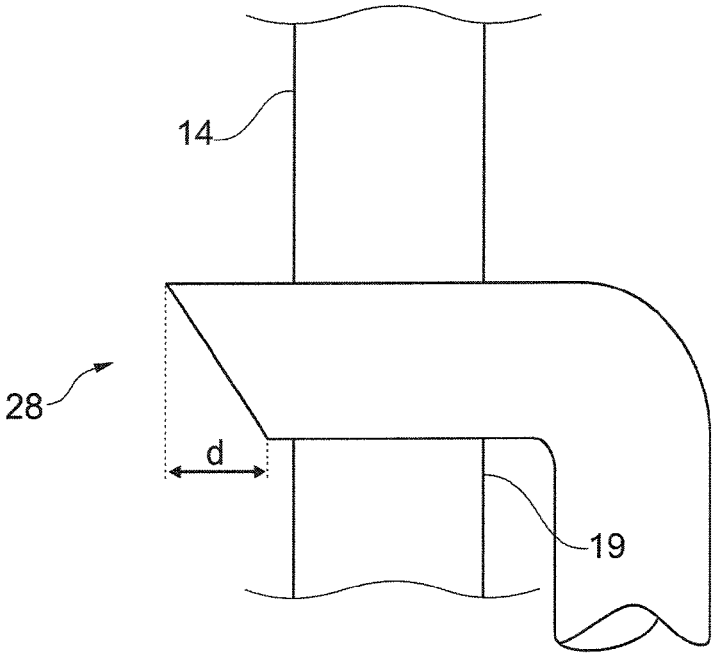
FIG. 7 schematically shows a detail of a fat drain according to a third variant.

FIG. 7 shows a variant of an embodiment in which the fat drain 28 opens obliquely in the interior of the cooking device. The upper portion of the fat drain 28 projects inward by a distance d, so that a type of canopy is formed. In this way, it is made more difficult for a cleaning liquid, for instance, to move into the fat drain 28 during a cleaning program, even in case an operator forgets to position an actually available plug in the fat drain 28.

All of the embodiments have in common that the fat drain 28 is located at a small distance above the bottom 16 of the cooking chamber 12. This ensures that in a cleaning process it is prevented to the greatest possible extent that cleaning liquid penetrates into the fat drain 28 unintentionally.

Basically, the fat drain 28 may also be mounted on side walls other than the rear wall. The special advantage of mounting it to the rear wall resides in that when the fat pan is inserted into the hang-in rack, it can be pushed by its spout extension 27 directly into the fat drain 28 without requiring any additional steps for establishing a connection here.

To make sure that the collected fat and the other cooking residues are reliably drained, the passage through the side wall 14 of the cooking device 10 preferably constitutes the narrowest cross-section; the pipes used downstream preferably have larger cross-sections.

A simple toggle closure, a ball valve or else a motor-driven valve may be used for the shut-off member 40.

If two or more cooking devices are installed in a spatial vicinity, the pipes of a plurality of cooking devices may also be made to merge before they open into a shared collecting container 38.

According to a further embodiment that is not illustrated in the drawings, the cooking device may be provided with a trough that serves to receive the collecting container 38. This allows any fat that may run out of the collecting container 38 to be collected.

Independently of the arrangement of the collecting container in a trough, provision may be made that a weight recognition of the collecting container is effected by means of a sensor (e.g., a strain gauge) and a warning message is issued when a predetermined weight is exceeded. Thereby, an operator may be requested to replace the approximately full collecting container with an empty one. It is also possible to monitor the filling rate of the collecting container. If a very high filling rate is detected, it is an indication that there is an undesirable operating condition. For instance, when the collecting container is filled rapidly during a cleaning process of the cooking device, this is clearly indicative of cleaning liquid entering the collecting container. A user may then be requested by the controller of the cooking device to terminate the cleaning process.

According to a further design variant that is not illustrated, if the cooking device involved is a floor-mounted device, two fat drains may be arranged at different levels, for instance a first fat drain in the middle and a second fat drain further down. The first fat drain prevents that fat from food to be cooked arranged at the top in the cooking chamber can drip onto food to be cooked positioned at a substantially lower level, where it may result in an alteration of the surface of the food to be cooked.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cooking device comprising:

a cooking chamber which includes a plurality of vertically arranged side walls, a top, a bottom, and an opening formed in one of the plurality of side walls;

a door movably arranged to obstruct the opening; and at least one fat drain, whereby the fat drain allows fat and other cooking residues to be discharged therethrough from the cooking chamber outward, wherein the fat drain comprises:

a conduit that extends through one of the plurality of vertically arranged side walls of the cooking chamber a small distance above the bottom to an exterior of the cooking chamber at a proximate end of the conduit; a collecting container located exterior to the cooking chamber connected to the distal end of the conduit, wherein a closure member is arranged on the end of the conduit.

2. A cooking device comprising:

a cooking chamber which includes a plurality of vertically arranged side walls, a top, a bottom; and at least one fat drain to allow fat and other cooking residues to be discharged therethrough from the cooking chamber outward, wherein the fat drain comprises:

a fat collecting pan located above the bottom of the cooking chamber;

a collecting container located outside of and below the cooking chamber;

a conduit that extends through one of the plurality of vertically arranged side walls of the cooking chamber a small distance above the bottom, wherein the conduit has a portion that extends obliquely laterally along the rear wall of the cooking chamber and wherein the conduit is directly coupled to the fat collecting pan at one end, and wherein the conduit extends to and terminates at the collecting container;

a closure member positioned to impede a flow of fluid through the fat drain, wherein the closure member is in the form of an automatic flap adapted to cooperate with the fat collecting pan.

3. A cooking device comprising:

a cooking chamber which includes a plurality of vertically arranged side walls, a top, a bottom; and at least one fat drain to allow fat and other cooking residues to be discharged therethrough from the cooking chamber outward, wherein the fat drain comprises:

a fat collecting pan located above the bottom of the cooking chamber;

a collecting container located outside of and below the cooking chamber;

a conduit that extends through one of the plurality of vertically arranged side walls of the cooking chamber a small distance above the bottom, wherein the conduit has a portion that extends obliquely laterally along the rear wall of the cooking chamber and wherein the conduit is directly coupled to the fat collecting pan at one end, and wherein the conduit extends to and terminates at the collecting container;

a closure member positioned to impede a flow of fluid through the fat drain, wherein the closure member is located within the cooking chamber.

* * * * *